US010450815B2

(12) United States Patent
Gardner et al.

(10) Patent No.: US 10,450,815 B2
(45) Date of Patent: Oct. 22, 2019

(54) FLOW RESTRICTOR SYSTEM

(71) Applicant: Cameron International Corporation, Houston, TX (US)

(72) Inventors: Laura M. Gardner, Cypress, TX (US); Matthew D. Givens, Houston, TX (US); Roger D. Williams, Kingwood, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 144 days.

(21) Appl. No.: 15/357,923

(22) Filed: Nov. 21, 2016

(65) Prior Publication Data

US 2018/0142531 A1 May 24, 2018

(51) Int. Cl.
*E21B 17/01* (2006.01)
*E21B 21/10* (2006.01)

(52) U.S. Cl.
CPC ..... *E21B 21/106* (2013.01); *E21B 17/01* (2013.01)

(58) Field of Classification Search
CPC ..... E21B 17/01; E21B 21/106; E21B 33/085; E21B 34/10
See application file for complete search history.

(56) References Cited

U.S. PATENT DOCUMENTS 899,558 A 9/1908 Petsche
1,277,427 A 9/1918 Knauf
3,380,479 A 4/1968 Bassan et al.
4,532,961 A 8/1985 Walton et al.
4,545,742 A 10/1985 Schaefer
4,601,342 A * 7/1986 Pringle ..... E21B 34/102 166/319
4,662,190 A 5/1987 Tischer
4,682,674 A 7/1987 Schmidt
4,846,225 A 7/1989 Scobie et al.
4,968,221 A 11/1990 Noll
4,972,867 A 11/1990 Ruesch
5,042,531 A 8/1991 Foster et al.
5,345,812 A 9/1994 Haboian
5,704,398 A 1/1998 Baker
5,996,687 A * 12/1999 Pringle ..... E21B 34/06 137/599.17
6,244,289 B1 6/2001 Hopfe et al.
6,397,892 B1 6/2002 Pyle et al.
6,425,283 B1 7/2002 Muller
6,453,658 B1 9/2002 Willis et al.
7,568,503 B2 8/2009 Gerber et al.
7,637,282 B2 12/2009 Gerber et al.
7,650,945 B2 * 1/2010 Brown ..... E21B 34/10 166/116
7,971,600 B2 7/2011 Gerber et al.
(Continued)

*Primary Examiner* — Matthew R Buck
(74) *Attorney, Agent, or Firm* — Helene Raybaud

(57) ABSTRACT

A system includes a flow restrictor assembly configured to be coupled to an annular structure having a central bore. The flow restrictor assembly includes one or more adjustable segments configured to move relative to the annular structure between a retracted position in which the one or more adjustable segments do not extend into the central bore and an extended position in which the one or more adjustable segments extend into the central bore to reduce a cross-sectional flow area of the central bore by between approximately 5 to 95 percent to restrict fluid flow through the central bore.

16 Claims, 3 Drawing Sheets

(56) References Cited

U.S. PATENT DOCUMENTS

| | | | | |
|---|---|---|---|---|
| 8,002,040 | B2 * | 8/2011 | May | E21B 34/10 137/513.3 |
| 8,555,980 | B1 * | 10/2013 | Powell | E21B 43/0122 166/363 |
| 8,631,812 | B2 | 1/2014 | Gerber et al. | |
| 8,794,308 | B1 * | 8/2014 | Milanovich | E21B 33/062 166/335 |
| 8,820,411 | B2 * | 9/2014 | Churchill | E21B 33/064 166/345 |
| 9,016,381 | B2 * | 4/2015 | Dietz | E21B 21/08 166/344 |
| 9,074,450 | B2 * | 7/2015 | Weir | E21B 33/06 |
| 9,080,427 | B2 * | 7/2015 | Ghasripoor | E21B 33/085 |
| 9,353,741 | B2 | 5/2016 | Gerber et al. | |
| 9,388,657 | B2 * | 7/2016 | Nelson | E21B 33/06 |
| 9,416,637 | B2 * | 8/2016 | Allouche | E21B 21/106 |
| 9,476,271 | B2 * | 10/2016 | Judge | E21B 47/101 |
| 10,100,622 | B2 * | 10/2018 | Gonzalez | E21B 43/12 |
| 2010/0096577 | A1 | 4/2010 | Gerber et al. | |
| 2012/0279719 | A1 * | 11/2012 | Baugh | E21B 17/10 166/349 |
| 2014/0110610 | A1 * | 4/2014 | Levett | E21B 33/06 251/1.1 |

* cited by examiner

FLOW RESTRICTOR SYSTEM

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to various other uses. Once a desired resource is discovered below the surface of the earth, drilling and production systems are often employed to access and extract the resource. An offshore drilling and production system may include a riser that connects a drilling rig to a wellhead assembly through which the resource is extracted. A drill string can be run from the drilling rig through the riser to a well. Drilling mud may be directed into the well through the drill string and returns to the surface via an annular space between the drill string and the riser. In some typical systems, fluid flow through the annular space may be controlled via one or more choke valves within a surface manifold system.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments are generally directed to systems for controlling and/or restricting fluid flow (e.g., gas and/or liquid fluid flow) within a drilling and production system. Certain embodiments include a flow restrictor system that may be utilized to control and/or restrict fluid flow through a central bore (e.g., passageway) extending through a component of a drilling and production system and/or through an annular space defined between two components of a drilling and production system. For example, the flow restrictor system may be configured to control and/or restrict fluid flow through an annular space defined between a drill string and a riser of the drilling and production system. During drilling operations, drilling mud may be directed into the well through the drill string and may return to the surface via the annular space between the drill string and the riser. The flow restrictor system disclosed herein may include one or more adjustable segments that move between a retracted position in which the one or more adjustable segments do not block fluid flow through the annular space and an extended position in which the one or more adjustable segments block fluid flow within the annular space. Thus, the disclosed embodiments may selectively restrict fluid flow through the annular space and/or may enable reduction in the size and/or weight of a surface manifold and/or clear space within the surface manifold that may otherwise be occupied by a flow control device (e.g., a choke valve), for example. While certain embodiments disclosed herein relate to offshore mineral extraction systems to facilitate discussion, it should be understood that the flow restrictor system may be utilized within onshore (e.g., land-based) mineral extraction systems.

Figure 1:
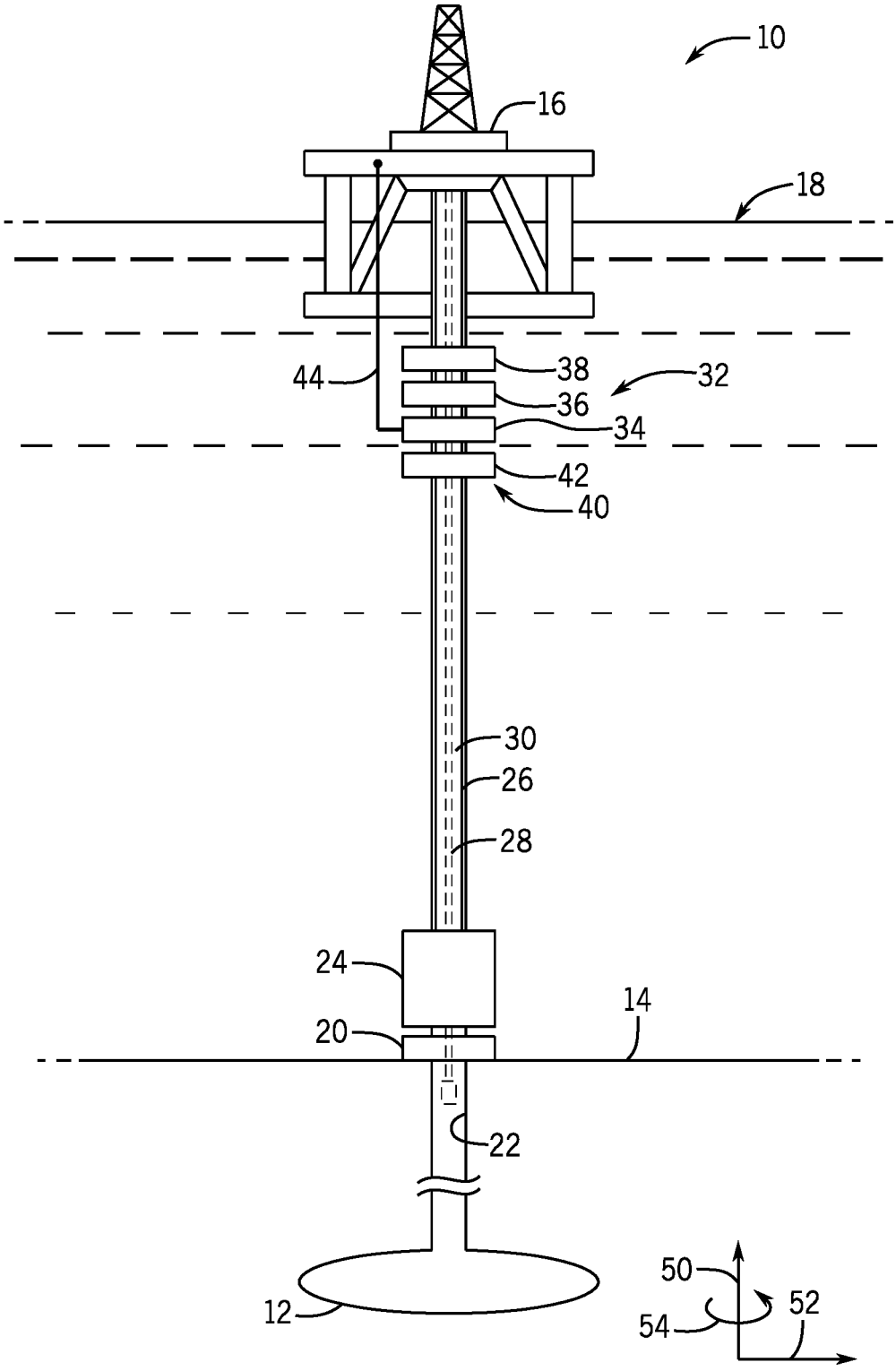
FIG. 1 is a schematic diagram of an offshore system, in accordance with an embodiment of the present disclosure.

With the foregoing in mind, FIG. 1 is an embodiment of an offshore system 10 configured to extract oil, natural gas, or other natural resources from a subsea mineral reservoir 12 below a sea floor 14. The offshore system 10 includes an offshore vessel or platform 16 at a sea surface 18. A wellhead 20 may be positioned at an interface between a wellbore 22 and the sea floor 14, and a stack assembly 24 having various components, such as blowout preventers (BOPs), to control pressure during drilling operations may be positioned adjacent to the wellhead 20. As shown, a tubular drilling riser 26 extends from the platform 16 toward the wellhead 20, and a drill string 28 (e.g., tubular string, production tubing string, or the like) extends from the platform 16, through the riser 26, and into the wellbore 22. During drilling operations, drilling mud is pumped through the drill string 28 toward the wellbore 22 to drive cuttings out of the wellbore 22. The drilling mud, cuttings, and/or other material may return toward the platform 16 via an annular space 30 (e.g., annulus) between the drill string 28 and the riser 26. When the wellbore 22 reaches the subsea mineral reservoir 12, oil, natural gas, or other natural resources may flow from the subsea mineral reservoir 12 through the annular space 30 toward the platform 16.

In certain embodiments, a riser gas handling system 32 is positioned along the riser 26 between the platform 16 and the wellhead 20. The riser gas handling system 32 may include various components to block and/or divert (e.g., redirect) fluid within the annular space 30 and/or to control pressure within the wellbore 22. In the illustrated embodiment, the riser gas handling system 32 is configured for managed pressure drilling and includes a diverter assembly 34 (e.g., flow spool), an annular BOP assembly 36, and a rotating control unit (RCU) assembly 38. Managed pressure drilling generally regulates the wellbore pressure by controlling the flow of mud through the drill string 28 and the return of fluid through the annular space 30. In operation, the RCU assembly 38 may form a seal (e.g., annular seal) between the drill string 28 and the riser 26 to block fluid flow through the annular space 30 to the platform 16. In certain embodiments, the annular BOP assembly 36 may also be utilized to block fluid flow through the annular space 30 to the platform 16, and may provide an additional seal (e.g., annular seal) between the drill string 28 and the riser 26 (e.g., during drilling operations) and/or may enable repair and/or replacement of the RCU assembly 38 or other structures above the annular BOP assembly 36 (e.g., during maintenance operations). In some embodiments, the fluid blocked by the RCU assembly 38 and/or the annular BOP assembly 36 may flow to a manifold or fluid processing system on the platform 16 via hoses 44 coupled to the diverter assembly 24.

As shown, the offshore system 10 includes a flow restrictor system 40, which includes a flow restrictor assembly 42. To facilitate discussion, certain embodiments disclosed herein relate to use of the flow restrictor assembly 42 within the riser 26. However, it should be understood that the flow restrictor assembly 42 may be used within any annular body and/or annular space of the offshore system 10. In the illustrated embodiment, the flow restrictor assembly 42 is positioned along the riser 26 axially below the diverter assembly 34 (e.g., between the diverter assembly 34 and the wellhead 20). In some embodiments, the flow restrictor system 40 may be part of the riser gas handling system 32. In some embodiments, multiple components of the riser gas handling system 32 (e.g., the diverter assembly 34, the annular BOP assembly 36, the rotating control unit (RCU) assembly 38, and/or the flow restrictor assembly 42) may be provided and/or coupled to a single body (e.g., one-piece body) or a single riser joint of the riser 26, or these components may be provided within and/or coupled to multiple riser joints that are coupled to one another at respective axial ends (e.g., via flanges) to form the riser 26. In such cases, it should be understood that the flow restrictor assembly 42 may be positioned at any suitable location along the riser 26 between the platform 16 and the wellhead 20 and/or relative to the components of the riser gas handling system 32. As discussed in more detail below, the flow restrictor system 40 may be configured to control fluid flow (e.g., restrict fluid flow and/or reduce a fluid flow rate) through the annular space 30. The flow restrictor system 40 may effectively control fluid flow through the annular space 30, thereby facilitating managed pressure drilling operations and/or protecting various components from surges in fluid flow rate and/or reducing wear on various components of the offshore system 10, for example. In some embodiments, the flow restrictor system 40 may advantageously enable a reduction in the size and/or weight of a surface manifold on the platform 16 and/or clear space within the surface manifold that may otherwise be occupied by a flow control device (e.g., a choke valve).

To facilitate discussion, the flow restrictor system 40 and other components of the offshore system 10 may be described with reference to an axial axis or direction 50, a radial axis or direction 52, and a circumferential axis or direction 54. Although the illustrated offshore system 10 is configured to use managed pressure drilling and the riser gas handling system 32 includes various components (e.g., the RCU assembly 38) to facilitate managed pressure drilling, it should be understood that the disclosed flow restrictor system 40 may be incorporated into any of a variety of offshore systems 10 or on-shore systems (e.g., land-based systems). For example, the flow restrictor system 40 may be utilized as part of an offshore system or an on-shore system that is configured for conventional drilling operations that maintain hydrostatic pressure within the wellbore 22 and without one or more of the RCU assembly 38, the annular BOP 36, and the diverter assembly 34. Furthermore, the disclosed flow restrictor system 40 may be utilized within other flow paths, bores, or annular spaces in drilling and production systems.

Figure 2:
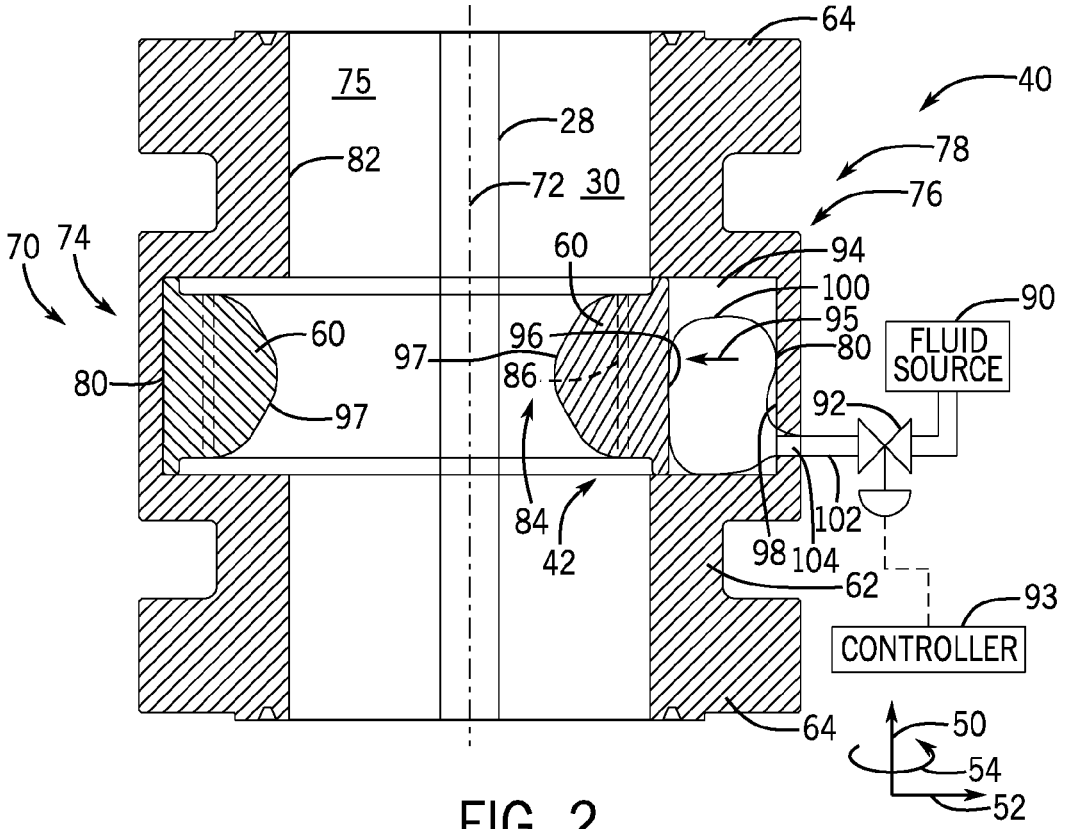
FIG. 2 is a cross-sectional side view of a flow restrictor system that may be used in the offshore system of FIG. 1, in accordance with an embodiment of the present disclosure.

FIG. 2 is a cross-sectional side view of an embodiment of the flow restrictor system 40 that may be used in the offshore system 10 of FIG. 1. As shown, the flow restrictor system 40 includes the flow restrictor assembly 42, which includes adjustable segments 60 (e.g., adjustable flow restrictor segments, structures, panels, arms, etc.) positioned within and/or coupled to a body 62 (e.g., annular body or riser joint). The illustrated annular body 62 may be coupled to adjacent annular bodies (e.g., adjacent annular bodies or adjacent riser joints) via flanges 64 (e.g., annular flanges) to form an annular or tubular structure (e.g., the riser 26) of the offshore system 10. As noted above, in some embodiments, one body, such as the body 62, may additionally include one or more of the RCU assembly 38, the annular BOP 36, and the diverter assembly 34.

To facilitate discussion, a first side 70 of a central axis 72 shows the adjustable segments 60 of the flow restrictor assembly 42 in a retracted position 74 (e.g., open position), and a second side 76 of the central axis 72 shows the adjustable segments 60 of the flow restrictor assembly 42 in an extended position 78 (e.g., fluid-blocking position). In the illustrated embodiment, the adjustable segments 60 may move (e.g., slide radially) relative to the body 62 between the retracted position 74 and the extended position 78 to selectively control and/or restrict fluid flow through the annular space 30. As shown, the adjustable segments 60 are supported within a recess 80 formed in a radially-inner surface 82 (e.g., annular surface) that defines a bore 75 (e.g., central bore) of the body 62. The recess 80 may extend circumferentially about at least a portion of the body 62, and in some embodiments, the recess 80 is a continuous annular structure (e.g., annular recess) that extends circumferentially about the body 62. In some embodiments, multiple recesses 80 may be provided about the body 62, and each of the multiple recesses 80 may support one or more adjustable segments 60.

In the retracted position 74, the adjustable segments 60 are positioned within the recess 80 and do not extend (e.g., protrude) radially from the recess 80 (e.g., does not extend beyond the radially-inner surface 82 along the radial axis 52) into the central bore 75 of the body 62 or into the annular space 30 between the drill string 28 and the radially-inner surface 82 of the body 62. Thus, in the retracted position 74, the adjustable segments 60 do not block or restrict fluid flow through the annular space 30. In the extended position 78, the adjustable segments 60 extend radially out of the recess 80 and into the bore 75 and the annular space 30 to block and/or restrict fluid flow through the annular space 30. Thus, when the adjustable segments 60 are in the extended position 78, a flow area (e.g., a cross-sectional area in a plane perpendicular to the axial axis 50) within the flow restrictor assembly 42 is reduced, as compared to the flow area when the adjustable segments 60 are in the retracted position 74. In some embodiments, the flow area may be reduced by at least equal to or greater than about 1, 5, 10, 20, 30, 40, 50, 60, 70, 80, 90, 95, percent, without sealing the annular space 30 or eliminating fluid flow axially across the adjustable segments 60. In some embodiments, the flow area may be reduced by between about 5 to 95, 10 to 90, 20 to 80, 30 to 70, or 40 to 60 percent.

In certain embodiments, in the extended position 78, the adjustable segments 60 do not contact the drill string 28. Rather, fluid may flow through a gap 84 (e.g., annular gap) between the adjustable segments 60 and the drill string 28. Additionally or alternatively, in certain embodiments, at least one of the adjustable segments 60 may include axially-extending holes 86 (e.g., channels or passageways) that enable fluid flow axially across the adjustable segments 60 when the adjustable segments 60 are in the extended position 78.

Figure 3:
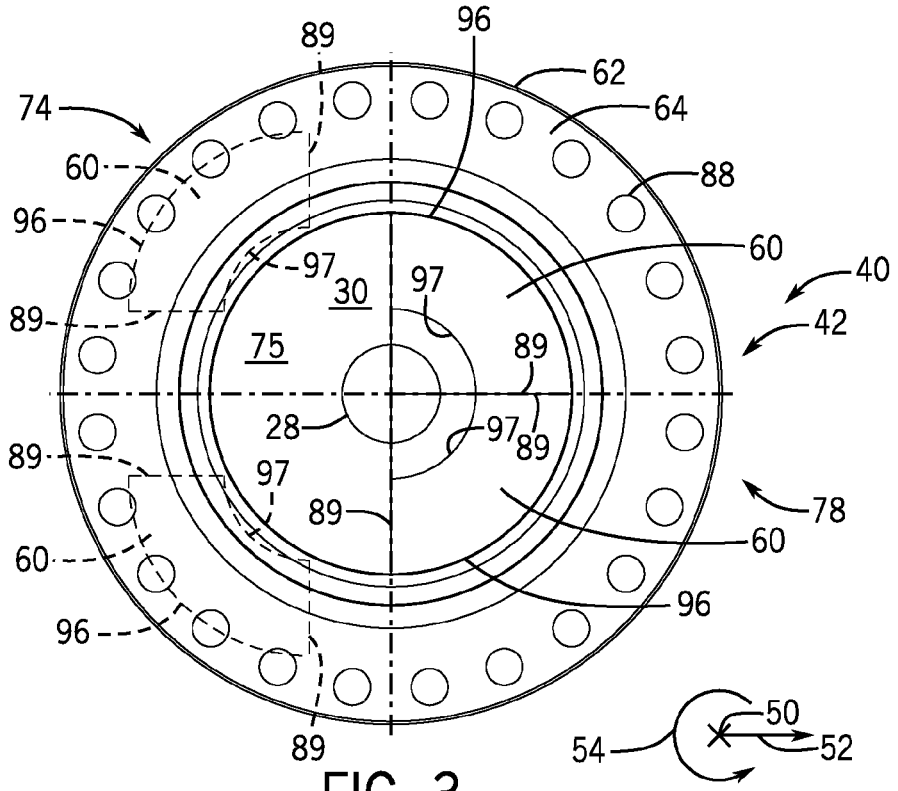
FIG. 3 is a top view of the flow restrictor system of FIG. 2, in accordance with an embodiment of the present disclosure.

The adjustable segments 60 may have any suitable shape and may be arranged in any suitable configuration that enables the adjustable segments 60 to move between the retracted position 74 and the extended position 78. For example, FIG. 3 is a top view of the body 62 of FIG. 2 having the adjustable segments 60 (e.g., first, second, third, and fourth segments). In the retracted position 74, the adjustable segments 60 are positioned within the recess 80 of the body 62, and in the extended position 78, the adjustable segments 60 extend into the bore 75 and the annular space 30. In certain embodiments, the adjustable segments 60 may be curved segments (e.g., curved along the circumferential axis 54), and be shaped (e.g., pie-shaped, wedge-shaped, v-shaped, triangular cross-sectional shape, or the like) and sized such that adjacent surfaces 89 (e.g., radially-extending surfaces) of the adjustable segments 60 contact one another and/or are in close proximity to one another to form a generally annular structure when the multiple adjustable segments 60 are in the extended position 78. As shown, each of the adjustable segments 60 includes the surfaces 89, a curved radially-outer surface 96, and a curved radially-inner surface 97. Furthermore, the curved radially-inner surface 97 may cause the fluid pressure to gradually change as the fluid flows across the adjustable segments 60, thereby facilitating fluid flow across the adjustable segments 60, for example.

In the example shown in FIGS. 2 and 3, the flow restrictor assembly 42 includes four discrete adjustable segments 60. However, it should be understood that any suitable number (e.g., 1, 2, 3, 4, 5, 6, 7, 8, 9, 10, or more) of adjustable segments 60 may be provided as part of the flow restrictor assembly 42. As shown in FIG. 3, the body 62 includes the flange 64 having multiple holes 88 (e.g., openings) that are configured to receive fasteners (e.g., threaded fasteners, such as bolts) to couple the body 62 to other components of the offshore system 10, such as adjacent bodies to form an annular structure, such as the riser 26, of the offshore system 10.

Returning to FIG. 2, in certain embodiments, the flow restrictor system 40 may include a fluid source 90 and a flow control device 92 (e.g., valve). In certain embodiments, upon operation of the valve 92 (e.g., controlling the valve 92 to an open position), a fluid (e.g., a liquid and/or gas) from the fluid source 90 may be provided to a space 94 (e.g., annular space or circumferentially-extending space) between respective radially-outer surfaces 96 of the adjustable segments 60 and an inner wall 98 (e.g., annular wall or circumferentially-extending wall) of the recess 80 formed in the body 62 to drive the adjustable segments 60 radially-inward into the annular space 30, as shown by arrow 95. In particular, when the radially-inward force exerted by the fluid from the fluid source 90 overcomes the radially-outward force exerted by the fluid within the annular space 30, the adjustable segments 60 move radially-inward into the annular space 30. In some embodiments, a reduction of fluid pressure within the space 94 may enable the fluid pressure within the annular space 30 to drive the adjustable segments 60 from the extended position 78 to the retracted position 74. In some embodiments, the radially-inward force may be controlled (e.g., via operation of the valve 92) to selectively adjust the radial position of the adjustable segments 60 and the flow area within the flow restrictor assembly 42.

In certain embodiments, the fluid may be provided to an expandable fluid container 100 (e.g., bag, annular flexible container, annular bellows) positioned within the space 94. The expandable fluid container 100 may be formed from a resilient material and/or may include plastic and/or metal materials. The expandable fluid container 100 may contain the fluid and prevent the fluid from escaping out of the space 94 (e.g., into the annular space 30), while also enabling the fluid to drive the adjustable segments 60 radially-inward into the annular space 30. For example, as the fluid fills the expandable fluid container 100, the expandable fluid container 100 expands and contacts the respective radially-outer surfaces 96 of the adjustable segments 60 to drive the adjustable segments 60 radially-inward into the annular space 30. As shown, the fluid source 90 is coupled to the body 62 via one or more conduits 102, and one or more openings 104 (e.g., channels or passageways) extend radially across the body 62 to provide the fluid from the fluid source 90 to the space 94 or to the expandable fluid container 100 positioned within the space 94. In some embodiments, the space 94 and/or the expandable fluid container 100 is annular and/or extends circumferentially about at least a portion of the body 62 such that provision of the fluid to the space 94 and/or to the expandable fluid container 100 drives the adjustable segments 60 relative to the body 62. In some embodiments, the fluid line 102 is branched and provides the fluid to multiple openings 104 and/or corresponding discrete spaces 94 and/or multiple expandable fluid containers 100 spaced circumferentially about the body 62 to drive the adjustable segments 60 relative to the body 62. It should be understood that the examples provided herein are not intended to be limiting, and that the adjustable segments 60 may have any suitable configuration that enables the adjustable segments 60 to move between the retracted position 74 and the extended position 78, and that the adjustable segments 60 may be driven into the bore 75 and the annular space 30 via any suitable actuator (e.g., piston-cylinder assemblies, or hydraulic, pneumatic, or electronic actuator) positioned within the body 62 or external to the body 62.

In certain embodiments, the fluid source 90 and/or the valve 92 are positioned at the platform 16 and may be operated by a user on the platform 16. In such cases, the fluid line 102 may extend through the body 62 and/or other conduit to the opening 104. In some embodiments, one or both of the fluid source 90 and/or the valve 92 is positioned subsea. In some such embodiments, the valve 92 may be operated via a controller 93 (e.g., electronic controller having a processor and a memory) at the platform 16 (e.g., based on operator inputs or automatically based on received data from sensors, such as data related to wellbore pressure and/or to a rate of fluid flow within the annular space 30). In some embodiments, the valve 92 may be operated via a remotely-operated vehicle (ROV) and/or an autonomously operated vehicle (AUV).

Figure 4:
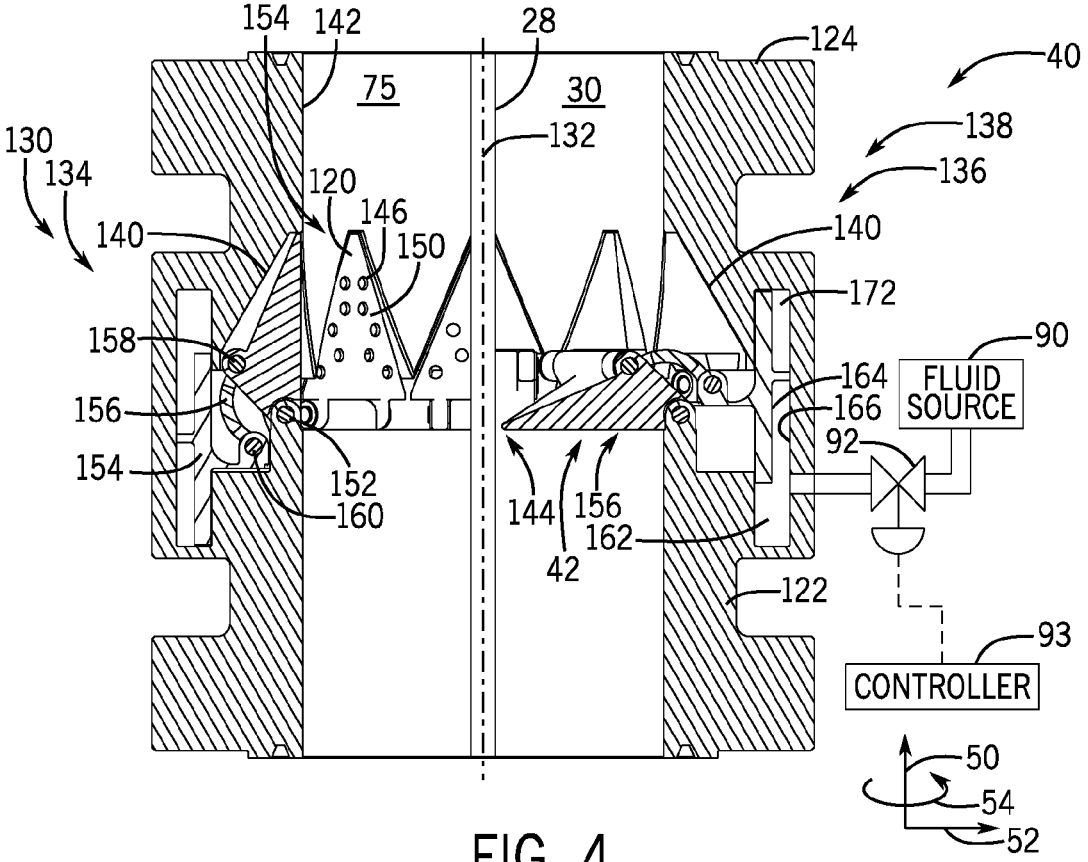
FIG. 4 is a cross-sectional side view of a flow restrictor system that may be used in the offshore system of FIG. 1, in accordance with another embodiment of the present disclosure.

FIG. 4 is a cross-sectional side view of another embodiment of the flow restrictor system 40 that may be used in the offshore system of FIG. 1. As shown, the flow restrictor system 40 includes the flow restrictor assembly 42, which includes adjustable segments 120 (e.g., adjustable flow restrictor segments, structures, panels, arms, etc.) positioned within and/or coupled to a body 122 (e.g., annular body, such as a riser joint). The illustrated body 122 may be coupled to adjacent bodies (e.g., adjacent riser joints) via flanges 124 (e.g., annular flanges) to form an annular structure (e.g., the riser 26) of the offshore system 10. As noted above, in some embodiments, one body, such as the body 122, may additionally include one or more of the RCU assembly 38, the annular BOP 36, and the diverter assembly 34.

To facilitate discussion, a first side 130 of a central axis 132 shows the adjustable segments 120 of the flow restrictor assembly 42 in a retracted position 134 (e.g., open position), and a second side 136 of the central axis 132 shows the adjustable segments 120 of the flow restrictor assembly 42 in an extended position 138 (e.g., fluid-blocking position). In the illustrated embodiment, the adjustable segments 120 may be configured to rotate relative to the body 122 between the retracted position 134 and the extended position 138 to selectively control and/or restrict fluid flow through the annular space 30. As shown, the adjustable segments 120 are supported within a recess 140 formed in a radially-inner surface 142 (e.g., annular surface) of the body 122. The recess 140 may extend circumferentially about at least a portion of the body 122, and in some embodiments, the recess 140 is a continuous annular structure that extends circumferentially about the body 122. In some embodiments, multiple recesses 140 may be provided about the body 122, and each of the multiple recesses 140 may support one or more adjustable segments 120. The recess 140 may have any suitable shape to support the adjustable segments 120.

In the retracted position 134, the multiple adjustable segments 120 are positioned within the recess 140 and do not extend (e.g., protrude) radially from the recess 140 (e.g., do not extend beyond the radially-inner surface 142 along the radial axis 52) into the bore 75 or the annular space 30 between the drill string 28 and the radially-inner surface 142 of the body 122. Thus, in the retracted position 134, the multiple adjustable segments 120 do not block or restrict fluid flow through the annular space 30. In the extended position 138, the multiple adjustable segments 120 extend radially out of the recess 140 and into the bore 75 or the annular space 30 to block and/or restrict fluid flow through the annular space 30. Thus, when the multiple adjustable segments 120 are in the extended position 138, a flow area (e.g., a cross-sectional area in a plane perpendicular to the axial axis 50) within the flow restrictor assembly 42 is reduced, as compared to the flow area when the adjustable segments 120 are in the retracted position 134. In some embodiments, the flow area may be reduced by at least equal to or greater than about 1, 5, 10, 20, 30, 40, 50, 60, 70, 80, 90, 95, percent, without sealing the annular space 30 or eliminating fluid flow axially across the adjustable segments 120. In some embodiments, the flow area may be reduced by between about 5 to 95, 10 to 90, 20 to 80, 30 to 70, or 40 to 60 percent.

In certain embodiments, in the extended position 138, the adjustable segments 120 do not contact the drill string 28. Rather, fluid may flow through a gap 144 (e.g., annular gap) between the adjustable segments 120 and the drill string 28. Additionally or alternatively, in certain embodiments, at least one of the adjustable segments 120 may include holes 146 (e.g., 1, 2, 3, 4, 5, 6, 7, 8, 9, 10, 15, 20, or more channels or passageways) that extend through the at least one of the adjustable segments 120 and enable fluid flow axially across the adjustable segments 120 when the adjustable segments 120 are in the extended position 138.

In the illustrated embodiment, each adjustable segment 120 includes a panel 150 (e.g., tapered panel) coupled to a hinge 152 (e.g., pivot) supported by the body 122. As shown, the panel 150 is also coupled to a piston 154 (e.g., an annular piston) via an arm 156 (e.g., arcuate linkage member). Although the panel 150 and the arm 156 are shown as separate components, it should be understood that the arm 156 may be integrally formed with the panel 150. In the illustrated embodiment, the arm 156 is coupled (e.g., non-rotatably coupled) to the panel 150 (e.g., via a fastener 158, such as a bolt or other threaded fastener), and the arm 156 is also coupled (e.g., rotatably coupled) to the piston 154 via a hinge 160 (e.g., pivot). As discussed in more detail below, the panel 150 may be configured to rotate or to pivot about the hinges 152, 160 between a generally vertical position 154 (e.g., along the axial axis 50) in the retracted position 134 to a generally horizontal position 156 (e.g., along the radial axis 52) in the extended position 138. As shown, respective rotational axes of the hinges 152, 160 may extend in a plane crosswise (e.g., perpendicular) to the central axis 132 and/or may extend in directions tangential to an inner circumference of the recess 140.

As discussed above, the flow restrictor system 40 may include the fluid source 90 and the valve 92. In certain embodiments, upon operation of the valve 92 (e.g., controlling the valve 92 to an open position), a fluid from the fluid source 90 may be provided to a space 162 (e.g., annular space) between a radially-outer surface 164 of the piston 154 of the adjustable segment 60 and an inner wall 166 (e.g., annular wall) of the recess 140 formed in the body 122 to drive the piston 154 in the axial direction 50. As the piston 154 moves in the axial direction 50, the arm 156 drives the panel 150 to rotate about the hinges 152, 160 from the generally vertical position 154 to the generally horizontal position 156 in which the panel 150 blocks fluid flow through the annular space 30. In some embodiments, during operation, a reduction of fluid pressure within the space 162 may enable the fluid within the annular space 30 to drive the adjustable segment 120 from the extended position 138 to the retracted position 134. However, in some embodiments, a fluid (e.g., from the fluid source 90) may be provided to another space 172 (e.g., annular space) to drive the adjustable segment 120 from the extended position 138 to the retracted position 134. In certain embodiments, the spaces 162, 172 may be sealed (e.g., via one or more annular seals) from the annular space 30 and/or the external environment.

As discussed above with respect to FIG. 2, in some embodiments, the space 162 is annular and/or extends circumferentially about at least a portion of the body 122 such that provision of the fluid to the space 162 drives the adjustable segments 120 to move relative to the body 122. In some embodiments, the fluid line 102 is branched and provides the fluid to multiple openings 104 and/or corresponding spaces 162 spaced circumferentially about the body 122 to drive the adjustable segments 120 to move relative to the body 122. Thus, one piston 154 may be coupled to and may drive all of the panels 150 between the extended position 138 and the retracted position 134, or multiple pistons 154 may be provided about the circumference of the body 122, and each of the multiple pistons 154 may be coupled to and drive a single panel 150 or to a subgroup of panels 150. Furthermore, as discussed above, in certain embodiments, the fluid source 90 and/or the valve 92 are positioned at the platform 16. In such cases, the fluid line 102 may extend through the body 122 and/or other conduit to the opening 104. In some embodiments, one or both of the fluid source 90 and/or the valve 92 is positioned subsea. In some such embodiments, the valve 92 may be operated via the controller 93 (e.g., based on operator input or automatically based on sensor data) at the platform 16. In some embodiments, the valve 92 may be operated via a remotely-operated vehicle (ROV) and/or an autonomously operated vehicle (AUV).

Figure 5:
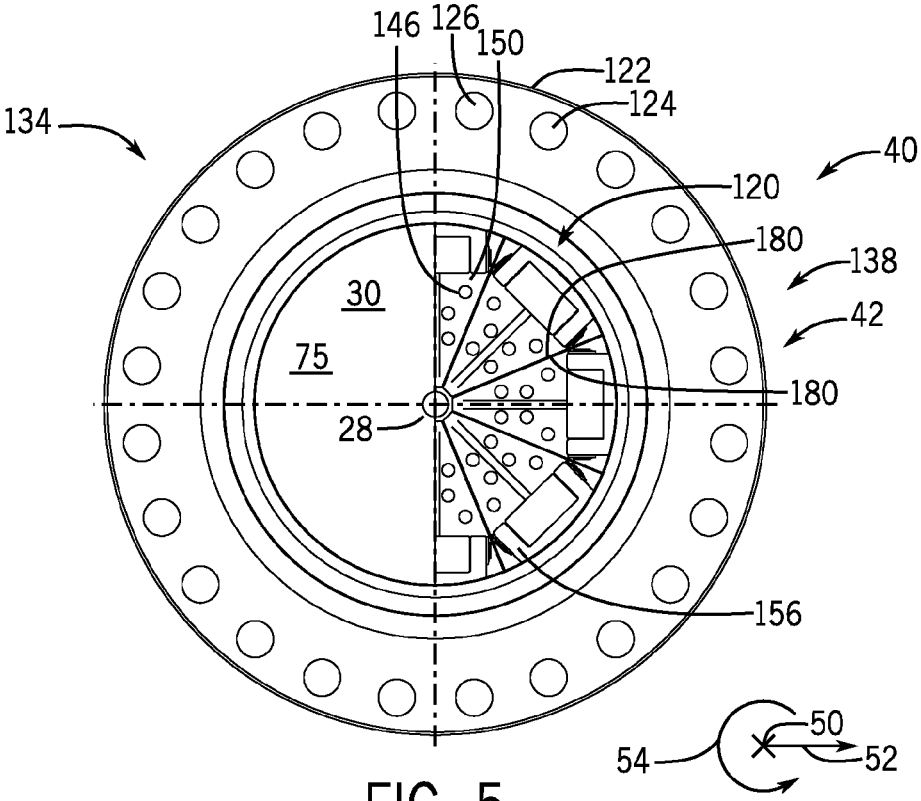
FIG. 5 is a top view of the flow restrictor system of FIG. 4, in accordance with an embodiment of the present disclosure.

FIG. 5 is a top view of the body 122 of FIG. 4. In the illustrated embodiment, the panels 150 of the adjustable segments 120 are positioned circumferentially about the body 122. In the retracted position 134, the adjustable segments 120 (e.g., eight segments) are positioned within the recess 140 of the body 122, and in the extended position 138, the adjustable segments 120 extend into bore 75 and the annular space 30. In certain embodiments, the adjustable segments 120 may have a tapered shape (e.g., pie-shape, wedge-shape, v-shape, a triangular cross-sectional shape, or the like) and be sized such that adjacent surfaces 180 (e.g., radially-extending when in the extended position 138, axially-extending when in the retracted position 134) of the adjustable segments 120 contact one another and/or are in close proximity to one another to form a generally annular shape 30 when the adjustable segments 120 are in the extended position 138. While multiple adjustable segments 120 and multiple panels 150 are shown in FIGS. 4 and 5, it should be understood that any suitable number (e.g., 1, 2, 3, 4, 5, 6, 7, 8, 9, 10, or more) of these components may be provided. As shown in FIG. 5, the body 122 includes the flange 124 having multiple holes 126 (e.g., openings) that are configured to receive fasteners (e.g., threaded fasteners, such as bolts) to couple the body 122 to other components of the offshore system 10, such as adjacent bodies to form an annular structure, such as the riser 26, of the offshore system 10.

It should be understood that the examples provided herein are not intended to be limiting, and that the flow restrictor system 40 may have any suitable configuration that enables the adjustable segments (e.g., adjustable segments 60, 120) of the flow restrictor assembly 42 to move between the retracted position and the extended position. Additionally, features of the disclosed embodiments may be combined in any suitable manner. For example, the expandable fluid container 100 may be positioned within the space 162 of FIG. 4 and utilized to drive the piston 154 in the axial direction 50 relative to the body 122, in a similar manner as described with respect to FIG. 2. It should be understood that the adjustable segments (e.g., the adjustable segments 60, 120) or certain components therein (e.g., the panels 150) may be formed from any suitable material, such a metal or metal alloy (e.g., tungsten carbide).

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a flow restrictor assembly configured to be coupled to an above ground annular structure having a central bore, the flow restrictor assembly comprising:

one or more adjustable segments configured to rotate about a hinge supported by the above ground annular structure between a retracted position in which the one or more adjustable segments do not extend into the central bore and an extended position in which the one or more adjustable segments extend into the central bore to reduce a cross-sectional flow area of the central bore by between approximately 5 to 95 percent to restrict fluid flow through the central bore.

2. The system of claim 1, wherein the one or more adjustable segments are configured to rotate in a radial direction relative to the annular structure between the retracted position and the extended position.

3. The system of claim 1, wherein the one or more adjustable segments comprise tapered panels positioned circumferentially about the annular structure.

4. The system of claim 1, wherein at least one of the one or more adjustable segments comprise holes to enable fluid flow axially across the one or more adjustable segments while the one or more adjustable segments are in the extended position.

5. The system of claim 1, wherein the one or more adjustable segments are supported within a recess formed in a radially-inner wall of the annular structure.

6. The system of claim 1, comprising a fluid source and a valve, wherein actuation of the valve enables fluid flow from the fluid source to a space defined between the one or more adjustable segments and the annular structure to drive the one or more adjustable segments from the retracted position to the extended position.

7. The system of claim 6, wherein the flow restrictor assembly comprises a piston positioned in the space and the one or more adjustable segments comprise one or more panels coupled to the annular structure via the hinge and to the piston via a second hinge, and wherein the fluid flow from the fluid source to the space causes the piston to move axially relative to the annular structure and to drive the one or more panels to rotate about the hinge and the second hinge from the retracted position to the extended position.

8. The system of claim 1, wherein the annular structure comprises a riser joint.

9. The system of claim 8, comprising the riser joint and a drill string extending through the central bore of the riser joint, wherein the one or more adjustable segments do not contact the drill string while the one or more adjustable segments are in the extended position.

10. The system of claim 1, wherein the system is an offshore drilling and production system configured for managed pressure drilling operations.

11. A system, comprising:

a flow restrictor assembly configured to be coupled to a riser joint, the flow restrictor assembly comprising:

one or more adjustable segments configured to rotate about a hinge supported by the riser joint between a retracted position in which the one or more adjustable segments do not extend into an annular space defined between a drill string and the riser joint and an extended position in which the one or more adjustable segments extend into the annular space to reduce a fluid flow rate while enabling fluid flow across the one or more adjustable segments.

12. The system of claim 11, wherein the one or more adjustable segments are configured to rotate in a radial direction relative to the riser joint between the retracted position and the extended position.

13. A system, comprising:

multiple adjustable segments positioned circumferentially about a riser joint and supported within a recess formed in a radially-inner surface of the riser joint, wherein the multiple adjustable segments are configured to rotate about a hinge supported by the riser joint between a retracted position in which the multiple adjustable segments do not extend out of the recess into a central bore of the riser joint and an extended position in which the multiple adjustable segments extend out of the recess into the central bore to enable the multiple adjustable segments to reduce a fluid flow rate through the central bore.

14. The system of claim 13, wherein the multiple adjustable segments are configured to rotate in a radial direction relative to the riser joint between the retracted position and the extended position.

15. The system of claim 13, wherein at least one of the multiple adjustable segments comprises holes to enable fluid flow axially across the multiple adjustable segments while the multiple adjustable segments are in the extended position.

16. The system of claim 13, wherein the riser joint is configured to receive a drill string, and the multiple adjustable segments are configured not to contact the drill string while the multiple adjustable segments are in the extended position.

* * * * *